US005950585A

United States Patent [19]

Sarcarto

[11] Patent Number: 5,950,585

[45] Date of Patent: Sep. 14, 1999

[54] SPARK PLUG ULTRASOUND WHISTLE

[76] Inventor: Walter E. Sarcarto, 2000 S. Acoma, Denver, Colo. 80223

[21] Appl. No.: 09/151,440

[22] Filed: Sep. 11, 1998

[51] Int. Cl.[6] ..... H01T 13/20

[52] U.S. Cl. ..... 123/169 R; 313/143

[58] Field of Search ..... 313/143; 123/169 R, 123/169 CL, 169 CA, 169 CB, 169 E, 143 B

[56] References Cited

U.S. PATENT DOCUMENTS

| | | | |
|---|---|---|---|
| 1,164,082 | 12/1915 | Gallant | 313/124 |
| 1,216,139 | 2/1917 | Kopf | 313/143 |
| 3,834,364 | 9/1974 | Bartholomew | 123/531 |
| 3,914,353 | 10/1975 | Cherry | 261/1 |

*Primary Examiner*—Tony M. Argenbright
*Assistant Examiner*—Arnold Castro
*Attorney, Agent, or Firm*—Edwin H. Crabtree; Donald W. Margolis; Ramon L. Pizarro

[57] ABSTRACT

A plurality of ultrasound whistles formed into a ceramic core of a conventional spark plug used in a cylinder of a gasoline combustion engine for greatly improved air fuel mixture prior to ignition. The spark plug with ultrasound whistles provides for increased engine performance and acceleration, improved fuel mileage and an improvement cleaner burning air fuel mixture thereby providing for reduced fuel emissions into the environment. The ultrasound whistles are constructed in the form of whistle holes. The whistle holes are disposed around a circumference of the ceramic core in a spaced relationship and next to the spark plug's electrode. The holes have a depth in a range of 0.032 to 0.050 inches. Also, the whistle holes have a diameter in a range of 0.031 to 0.033 inches. Around the top of the small closed end whistle holes are upwardly extending lips. The upwardly extending lips have a height above the surface of the ceramic core of 0.015 to 0.040 inches. The combined structure of the size of the whistle holes in the ceramic core and the upwardly extending lips accelerate the air fuel mixture from 100 feet per second to when ignition occurs in the engine, the ignition rate or burn rate is driven into an ultra sound frequency range of 5000 cycles per second. The increased speed of the air fuel mixture creates a greater and more homogenous air fuel mixture prior to and during ignition in the engine cylinder.

16 Claims, 1 Drawing Sheet

SPARK PLUG ULTRASOUND WHISTLE

BACKGROUND OF THE INVENTION (a) Field of the Invention

This invention relates to improved spark plug performance and more particularly, but not by way of limitation, to a spark plug with a plurality of whistles for improving air fuel mixture prior to ignition and during ignition in a gasoline combustion engine.

(b) Discussion of Prior Art

In U.S. Pat. No. 3,143,401 to Lambrecht, U.S. Pat. No. 3,544,290 to Larson et al., U.S. Pat. No. 3,720,290 to Lansky et al., U.S. Pat. No. 3,730,160 to Hughes, U.S. Pat. No. 3,829,015 to Monro, U.S. Pat. No. 5,477,822 to Haghgooie et al., U.S. Pat. No. 3,857,375 to Jackson and U.S. Pat. No. 3,914,353 to Cherry various types of ultrasonic fuel injection devices and atomizing fuel inventions are described. None of these prior art patents disclose or teach the use of ultrasound whistles disposed in the sides of a ceramic core of a spark plug for improved gasoline engine performance and added benefits described herein.

In a text book published by McGraw Hill, 1960, titled "Whistle Ultrasonics" by Benson Carlin, whistle type ultrasound is described operating in a range of 5000 to 10,000 cycles per second. The frequency wave length for ultrasound is 8 inches in solid material, 2.4 inches in liquids and approximately 0.63 inches in atmospheric air. The type of wave produced by whistles are longitudinal and "L" waves. An ultrasonic wave in a gas or in an air fuel mixture starts out as a longitudinal wave and when it strikes particles of fuel, it turns into a "L" wave. The more particles of fuel the "L" wave hits, the more excited it becomes. When the "L" wave strikes the side of a spark plug and any other metal surface in it's path, the wave is amplified twice. The more surfaces the ultrasound wave strikes, the greater the acceleration. When sound waves are traveling through various mediums, the waves are reflected, refracted, defracted, scattered and multiplied. Like any whistle sound, the more air that crosses the whistle, the more the volume it produces. Today, ultrasound is used in a variety of industries for cleaning, metal testing and like applications.

SUMMARY OF THE INVENTION

In view of the foregoing, it is a primary object of the subject invention to provide a conventional spark plug with ultrasound whistles for greatly improved air fuel mixture prior to ignition in an gasoline engine.

Another object of the invention is the spark plug with ultrasound whistles provides for increased engine performance and acceleration and improved fuel mileage, Still another object of the improved spark plug is to provide a cleaner burning air fuel mixture thereby providing for reduced fuel emissions into the environment. The formed whistles in the ceramic core will also extend the life of the plug under normal operating conditions. The plug is not subject to electrical erosion and the porcelin of the plug is designed to be self cleaning.

Yet another object of the invention is to accelerate the speed of the air fuel mixture inside a combustion cylinder wherein the air fuel mixture is increased from 100 feet per second to an ultrasound range of 5000 cycles per second. The increased speed of the air fuel mixture creates a greater and more homogenous air fuel mixture prior to ignition in the engine cylinder.

The subject invention includes ultrasound whistles constructed in the form of whistle holes in a spark plug. The whistle holes are disposed around a circumference of the ceramic core in a spaced relationship and next to the spark plug's electrode. The holes have a depth in a range of 0.032 to 0.050 inches. Also, the whistle holes have a diameter in a range of 0.031 to 0.033 inches. Around the top of the small closed end whistle holes are upwardly extending lips. The upwardly extending lips have a height above the surface of the ceramic core of 0.015 to 0.040 inches. The combined structure of the size of the whistle holes in the ceramic core and the upwardly extending lips accelerate the air fuel mixture from 100 feet per second to an ultrasound range of 5000 cycles per second. The increased frequency and speed of the air fuel mixture creates a greater and more homogenous air fuel mixture prior to and during ignition in the engine cylinder.

These and other objects of the present invention will become apparent to those familiar air fuel mixtures in an internal combustion engine, the use of ultrasound and whistles operating in an ultrasound range of 5000 cycles per second and greater when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
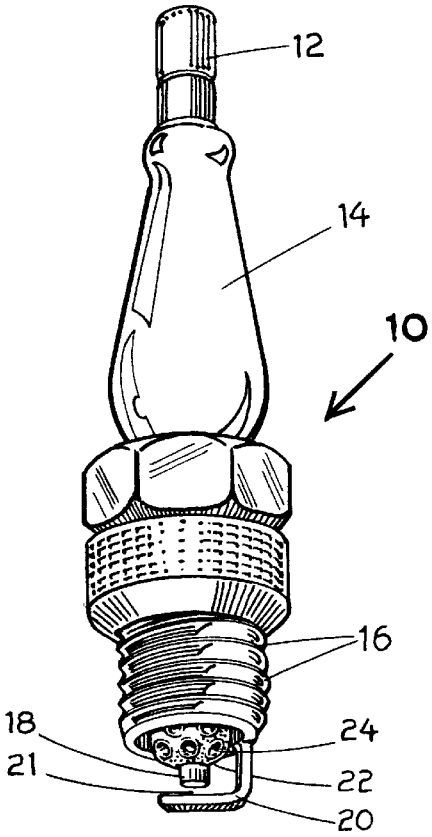
FIG. 1 is a perspective view of a standard spark plug with the subject invention incorporated into a ceramic core of the spark plug.

In FIG. 1, a perspective view of a standard spark plug having a general reference numeral 10. The spark plug 10 includes an ignition wire cap 12, a spark plug body 14, threads 16 for mounting the spark plug 10 in a gasoline engine motor block, an electrode 18 for igniting the air fuel mixture inside a combustion cylinder and an electrode ground 20 disposed next to an end of the electrode 18. A gap 21 is shown therebetween the end of the electrode ground 20 and a portion of the electrode ground 20. A circular ceramic core 22 is disposed around an upper portion of the electrode 18. The ceramic core acts as an insulator for the electrode 18 during the ignition of the air fuel mixture. The downwardly extending exposed end of the electrode 18 typically has a diameter in a range of 0.060 to 0.10 inches. Formed in the ceramic core 22 are a plurality of ultrasound whistles 24 making up the subject invention.

Figure 2:
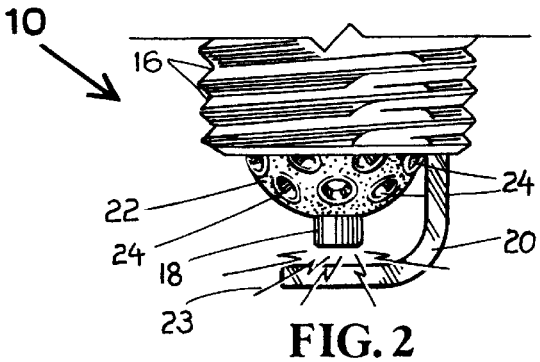
FIG. 2 is an enlarged side view of a lower portion of the spark plug illustrating the ultrasound whistles disposed in the side of the ceramic core.

In FIG. 2, an enlarged side view of a lower portion of the spark plug 10 is shown illustrating the ultrasound whistles 24. In this view the whistles are shown disposed in the side of the ceramic core 22 and in a spaced relationship to each other. The number of ultrasound whistles may vary from 3 up to 12 or more. In the gap 21 are broken lines 23 used to illustrate the ignition and burning of the air fuel mixture at the end of the spark plug 10.

Figure 3:
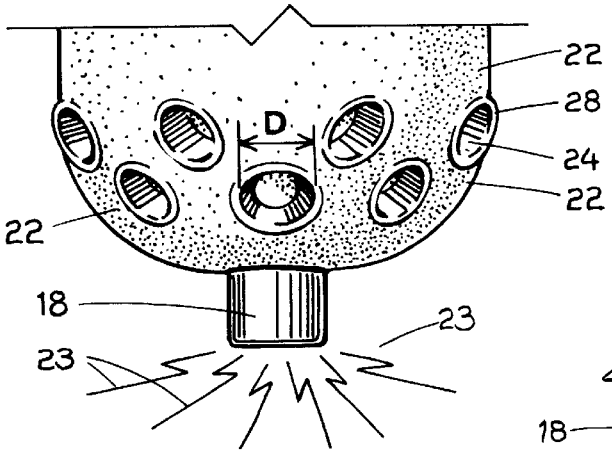
FIG. 3 is a greatly enlarged side view of the lower portion of the spark plug with the ultrasound whistles in a spaced relationship to each other and disposed around the circumference of the ceramic core.

In FIG. 3, a greatly enlarged side view of the lower portion of the spark plug 10 is illustrated wherein the ultrasound whistles 24 are shown in a spaced relationship to each other and disposed around the circumference of the ceramic core 22. The electrode ground 20 is not shown in this drawing. In this view, the whistles 24 are shown made up of a plurality of whistle holes 26. The whistle holes 26 have a diameter "D". The diameter "D" may be in a range of 0.031 to 0.033 inches. The whistle holes 26 have a closed end. At the top of each hole is a raised lip 28 therearound which is used to increase the speed of the air fuel mixture as it passes over the top of each whistle hole 26.

Figure 4:
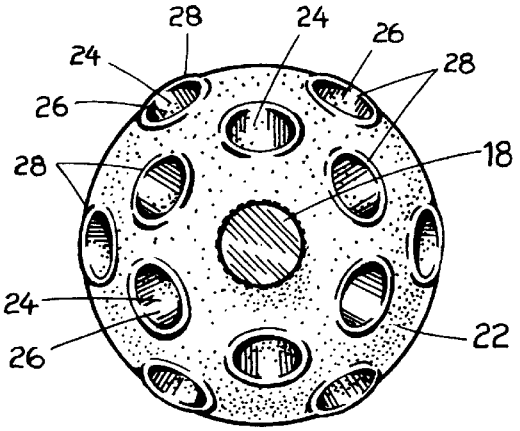
FIG. 4 is a greatly enlarged front view of the ceramic core of the spark plug with the ultrasound whistles in a spaced relationship to each other and disposed around the circumference of the ceramic core.

In FIG. 4, a greatly enlarged front view of the ceramic core 22 is shown with the ultrasound whistles 24 with whistle holes 26 in a spaced relationship to each other and disposed around the circumference of the ceramic core 22 and around the outwardly extending end of the electrode 18.

Figure 5:
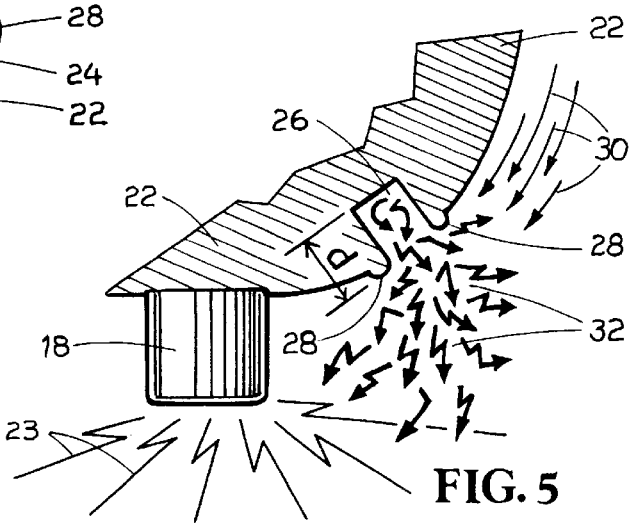
FIG. 5 is a greatly enlarged cross sectional view of a portion of the ceramic core illustrating an ultrasound whistle hole formed in the ceramic core with the whistle hole having upwardly extending lips disposed around the top of the hole. Also arrows are shown to illustrate laminar flow of the air fuel mixture prior to passing over the top of the whistle hole and arrows illustrating the increased speed, turbulence and mixing of the air fuel mixture at ultrasound speed when passing over the top of the whistle hole.

In FIG. 5, a greatly enlarged cross sectional view of a portion of the ceramic core 22 is illustrating. In this view, the ultrasound whistle hole 26 is shown formed in the ceramic core 22 with the whistle hole 26 having an upwardly extending lip 28 disposed around the top of the hole 26. The height of the lip 28 above the surface of the ceramic core 22 is approximately 0.015 inches. The hole has a depth "d". The depth "d" is in a range of 0.032 to 0.050 inches.

Also shown in this drawing are long arrows 30 which illustrate laminar flow of a typical air fuel mixture prior to passing over the top of the whistle hole 26 and having a typical speed up to 100 feet per second prior to combustion. Short arrows 32 illustrate what starts out as a longitudinal wave and then when the sound wave hits an air fuel particle it becomes a "L" wave. As the "L" waves 32, as shown in FIG. 5, hit additional air fuel particles, the speed increases with added turbulence and increased mixing of the air fuel mixture at ultrasound frequencies in a range of 5000 cycles per second and greater. This important feature provides for an increase of 500 per cent in the air fuel movement past the spark plug 10.

When the air fuel mixture represented by arrows 30 passes over the top of the whistle hole 26, a vacuum is draw therein. With the lip 28 around the top of the hole 26, the laminar flow of the air fuel mixture is broken up and turbulence is created. With the turbulence of the air fuel mixture, a more complete mixture of the air and fuel occurs. Also, the air fuel mixture accelerates thus creating, as indicated by the "L" waves 32, a more homogenous air fuel mixture prior to ignition. The use of the whistles 24 on the ceramic core 22 provide, as mentioned above, for more rapid fire and efficient burning of the fuel thereby greatly reducing fuel emissions into the environment.

In the testing of the subject invention, a gas engine operates at various densities and pressures. In the combustion chamber of the engine and at the time just before ignition occurs, a maximum density and sound frequency using the whistles 24 is reached with a wave length of upward to 2.0 inches. This increase of wave length with the "L" waves 32 provides for greater turbulence and mixing of the air fuel mixture prior to and during ignition. When ignition occurs, the pressure in the chamber escalates along with the ultrasound frequency produced by the whistles 24. The increase in sound frequency drives the burn rate upward into a range of 5000 to 10,000 cycles per second. This is compared to a standard gas engine operating with no ultrasound frequency and at a burn rate of 100 feet per second.

With a gas engine using the ultrasound whistles and operating at a burn rate of 5000 to 10,000 cycles per second, fuel efficiency improves by 35 to 50 percent with 50 percent reduction in emissions and improved engine horsepower in a range of 25 to 40 percent depending on the rpm of the engine.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An ultrasound whistle formed into a ceramic core of a conventional spark plug used in a cylinder of a gasoline combustion engine for providing greatly improved air fuel mixture prior to and during ignition, the ultrasound whistle comprising:

at least one whistle hole formed in the ceramic core of the spark plug, said whistle hole greatly accelerating the speed of the air fuel mixture as it passes over a top of said whistle hole and prior to ignition.

2. The ultrasound whistle as described in claim 1 wherein said whistle hole has an upwardly extending lip around the top of said whistle hole.

3. The ultrasound whistle as described in claim 1 further including a plurality of whistle holes disposed in a spaced relationship around a circumference of the ceramic core.

4. The ultrasound whistle as described in claim 1 wherein said whistle hole has a depth in a range of 0.032 to 0.050 inches.

5. The ultrasound whistle as described in claim 1 wherein said whistle hole has a diameter in a range of 0.031 to 0.033 inches.

6. The ultrasound whistle as described in claim 1 wherein said whistle hole accelerates an air fuel mixture passing thereby to an ultrasound frequency range of 5000 to 10,000 cycles per second for creating a greater air fuel mixture prior to and during ignition.

7. Ultrasound whistles formed in a ceramic core of a conventional spark plug used in a cylinder of a gasoline combustion engine for providing greatly improved air fuel mixture prior to and during ignition, the ultrasound whistles comprising;

a plurality of whistle holes formed in the ceramic core of the spark plug and disposed in a spaced relationship to each other, said whistle holes greatly accelerating the speed of the air fuel mixture as it passes over a top of said whistle hole and prior to ignition.

8. The ultrasound whistles as described in claim 7 wherein each of said whistle holes has an upwardly extending lip around the top of said whistle hole.

9. The ultrasound whistles as described in claim 8 wherein said upwardly extending lip has a height in a range of 0.015 to 0.040 inches.

10. The ultrasound whistles as described in claim 7 wherein said whistle holes have a depth in a range of 0.032 to 0.050 inches.

11. The ultrasound whistles as described in claim 6 wherein said whistle holes have a diameter in a range of 0.031 to 0.033 inches.

12. The ultrasound whistles as described in claim 6 wherein said whistle holes accelerates an air fuel mixture passing over a top thereof from 100 feet per second up to an ultrasound frequency range of 5000 cycles per second and greater for creating a greater air fuel mixture prior to and during ignition.

13. Ultrasound whistles formed in a ceramic core of a conventional spark plug used in a cylinder of a gasoline combustion engine for providing greatly increased acceleration of an air fuel mixture upward to an ultrasound frequency in a range of 5000 cycles per second and greater prior to and during ignition, the ultrasound whistles comprising:

a plurality of whistle holes formed in the ceramic core of the spark plug and disposed in a spaced relationship to each other, said whistle holes greatly accelerating the speed of the air fuel mixture as it passes over a top of said whistle holes and prior to ignition, said whistle holes having an upwardly extending lip around the top of said whistle holes.

14. The ultrasound whistles as described in claim 13 wherein said upwardly extending lip has a height in a range of 0.015 to 0.040 inches.

15. The ultrasound whistles as described in claim 13 wherein said whistle holes have a depth in a range of 0.032 to 0.050 inches.

16. The ultrasound whistles as described in claim 13 wherein said whistle holes have a diameter in a range of 0.031 to 0.033 inches.

* * * * *